US005319384A

United States Patent [19]

Isenberg et al.

[11] Patent Number: 5,319,384

[45] Date of Patent: Jun. 7, 1994

[54] METHOD FOR PRODUCING A GRAPHICAL CURSOR

[75] Inventors: Henri J. Isenberg, Los Angeles, Calif.; Manny Taub, Jerusalem, Israel

[73] Assignee: Symantec Corporation, Cupertino, Calif.

[21] Appl. No.: 713,426

[22] Filed: Jun. 10, 1991

[51] Int. Cl.[5] ..... G09G 1/16

[52] U.S. Cl. ..... 345/145; 345/143; 345/157

[58] Field of Search ..... 340/706, 707, 708, 709, 340/710, 734, 735, 748, 799; 395/144, 150, 151; 345/124, 121, 143, 145, 157

[56] References Cited

U.S. PATENT DOCUMENTS

| | | | |
|---|---|---|---|
| 3,911,419 | 10/1975 | Bates et al. | 340/709 |
| 4,445,194 | 4/1984 | Cason et al. | 340/709 |
| 4,491,832 | 1/1985 | Tanaka | 340/735 |
| 4,495,491 | 1/1985 | Postl | 340/709 |
| 4,566,000 | 1/1986 | Goldman et al. | 340/709 |
| 4,587,520 | 5/1986 | Astle | 340/709 |
| 4,599,610 | 7/1986 | Lacy | 340/709 |
| 4,622,546 | 11/1986 | Sfarti et al. | 340/799 |
| 4,668,947 | 5/1987 | Clarke, Jr. et al. | 340/709 |
| 4,686,521 | 8/1987 | Beaven et al. | 340/748 |
| 4,706,074 | 11/1987 | Muhich et al. | 340/709 |
| 4,734,685 | 3/1988 | Watanabe | 340/710 |
| 4,768,029 | 8/1988 | Burrows | 340/709 |
| 4,987,551 | 1/1991 | Garrett, Jr. | 340/734 |

FOREIGN PATENT DOCUMENTS

| | | | |
|---|---|---|---|
| 2151381 | 7/1985 | United Kingdom | 340/709 |

*Primary Examiner*—Alvin E. Oberley
*Assistant Examiner*—Steven J. Saras
*Attorney, Agent, or Firm*—Greg T. Sueoka; Edward J. Radlo; Leo V. Novakoski

[57] ABSTRACT

A graphical cursor in text mode is generated by replacing the characters on the display at positions under the cursor with new fonts comprising an image of the cursor superimposed on the image of the characters. The method of the present invention comprises the steps of: determining the new cursor position; restoring the characters at the old cursor position; saving a plurality of the characters near the new cursor position; building new fonts with the plurality of characters near the new cursor position and the cursor symbol; and replacing the plurality of characters at the new cursor position with the new fonts. The preferred method may further comprise the step of detecting the position and movement of the input device when mouse-type input devices are used.

9 Claims, 8 Drawing Sheets

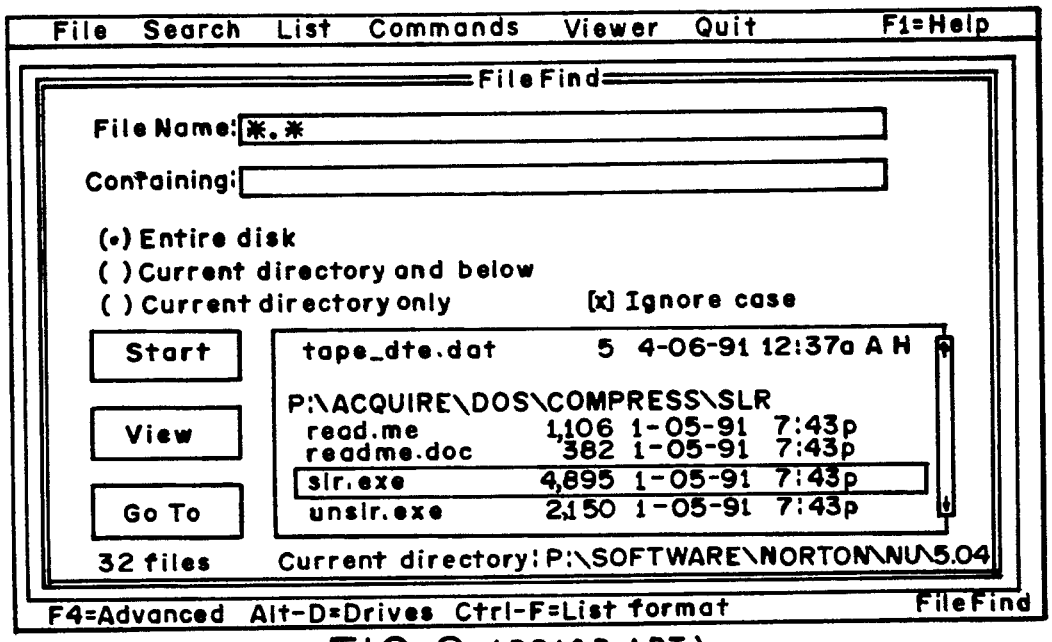
FIG. 2 (PRIOR ART)
FIG. 3 (PRIOR ART)
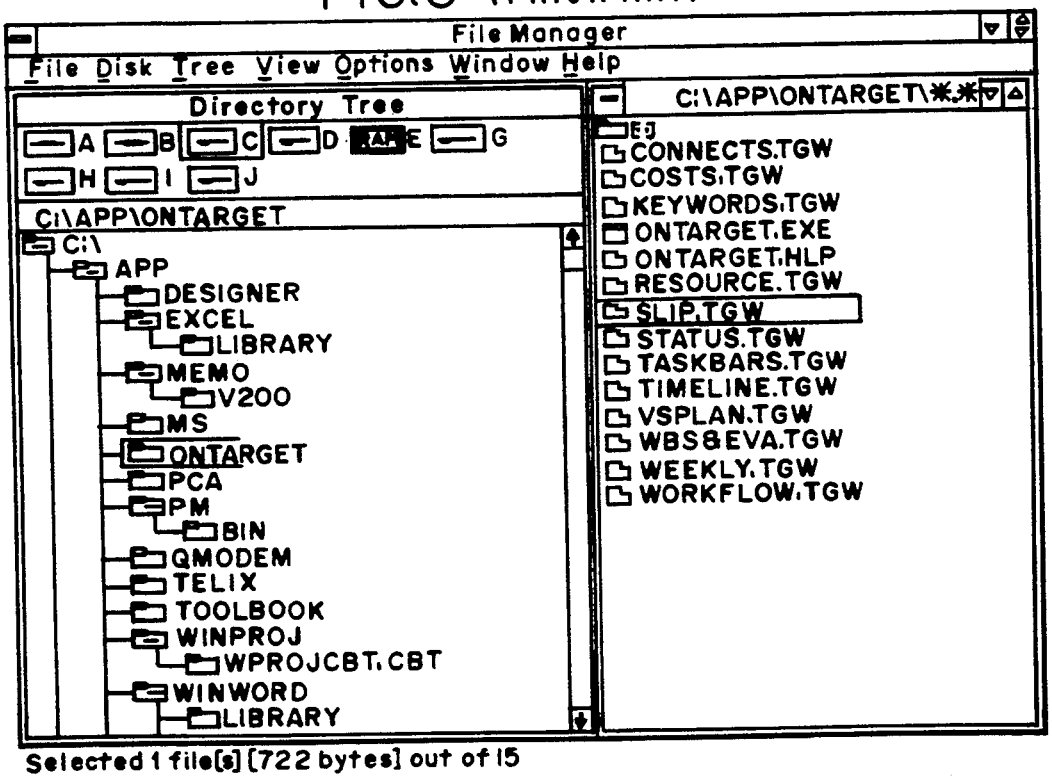

METHOD FOR PRODUCING A GRAPHICAL CURSOR

BACKGROUND OF THE INVENTION

1. Field of the Invention

The present invention relates to computers and display devices. In particular, the present invention relates to a method for producing a graphical mouse cursor on a display device while operating in text mode.

2. Description of Related Art

Conventional computer systems commonly use a display adapter and a display device to present information to the user. The display adapter and display device are coupled to a processing unit to produce the images on the display device. The processing unit is also coupled to an input device such as a keyboard or mouse-type controller to receive data from the user. The processing unit modifies the information shown on the display device in response to user manipulation of the input device.

One method used extensively in the art for producing images on a display device is referred to as text mode operation or a text user interface. FIG. 2 illustrates a screen display of a text user interface. The computer displays information using letters, numbers, and punctuation. The standard IBM set of characters and symbols is illustrated in FIG. 4. The text user interface can use special symbols (e.g. a happy face and lines) to create graphical images to a limited degree. However, because the character set is limited, typically to 256 characters, the capability for producing graphical images is severely restricted.

In text mode operation, the screen is divided into a fixed grid, usually 80 columns by 25 lines. Each position in the grid provides an area for the display of a character or symbol. The display adapter controls the video screen, and in "text mode" is also responsible for converting characters into the actual dots that appear on the screen. For example, the processing unit of the computer provides a signal representing the character to be produced on the display at a given row and column, and the display adapter generates the appropriate pattern of dots on the video screen for the signal from the processing unit. Because only a relatively small amount of information must be processed (only 2000 characters per screen at 80 by 25), text user interfaces are very fast and memory efficient.

Another method used to produce images on a display device is the graphics mode or a Graphical User Interface (GUI). An example of a screen displaying a graphical user interface is shown in FIG. 3. A GUI is produced by controlling each individual screen dot, thereby allowing any type of character or graphic image to be displayed. In graphics mode, the processing unit of the computer system is responsible for managing all of the individual dots. The display adapter provides no assistance in forming characters when in graphics mode. Since GUIs force the processing unit to handle a large volume of data (over 300,000 dots on the average PC screen), they are slower and require more memory than text user interfaces. The memory and processing overhead prevents most older computers from using a GUI, and even on newer computers many users prefer the higher speed and memory efficiency of a text interface.

Another difference between a text user interface and a GUI is the display and movement of the cursor. On a GUI, the cursor usually looks like an arrow, and it moves smoothly across the screen as the user moves the mouse. On a text system, the cursor is a rectangular block displayed in a different color than the rest of the data. Because text systems have a fixed display grid (80 by 25), the movement of the cursor appears "choppy"60 and doesn't always reflect the actual motion of the mouse. This lack of precision detracts for the usefulness of the mouse.

Therefore, there is a need for a method for producing a mouse-type cursor that has smooth movement and improved precision without significantly reducing processing speed and requiring large amounts of memory.

SUMMARY OF THE INVENTION

The present invention overcomes the deficiencies of the prior art with a method for producing a cursor with smooth movement and improved precision in text mode. The present invention produces a graphical cursor in text mode by replacing the characters on the display at positions under the cursor with new fonts comprising an image of the cursor superimposed on the image of the characters. A preferred embodiment of the method of the present invention comprises the steps of: determining the new cursor position; restoring the characters at the old cursor position; saving a plurality of the characters near the new cursor position; building new fonts with the plurality of characters near the new cursor position and the cursor symbol; and replacing the plurality of characters at the new cursor position with the new fonts. The preferred method may further comprise the step of detecting the position and movement of the input device when mouse-type input devices are used. The preferred method of the present invention is repeatedly performed by a computer system thereby producing the display of a cursor symbol with improved precision and smoother movement.

BRIEF DESCRIPTION OF THE DRAWINGS

FIG. 2 is a graphical representation of a display device showing a cursor and data in text mode;

FIG. 3 is a graphical representation of a display device showing a cursor and data in graphics or GUI mode;

DETAILED DESCRIPTION OF A PREFERRED EMBODIMENTS

The present invention provides a method for producing and displaying a graphical cursor 34 during operation of a computer system in text mode. In the preferred embodiment, the graphical cursor 34 is generated by displaying a plurality of new fonts in place of the character fonts with the same position on the display as the cursor 34. The new fonts are produced by superimposing a symbol representing the cursor 34 over the character fonts at the cursor's position. The present invention allows the symbol of the cursor 34 to be superimposed in a plurality of positions such that the symbol for the cursor 34 can cover a variety of areas within a group of characters. The variety of positions for superimposing the cursor symbol eliminates the choppy appearance for movement of the cursor 34 as well as adding to the precision of the positioning of the cursor 34.

Figure 1:
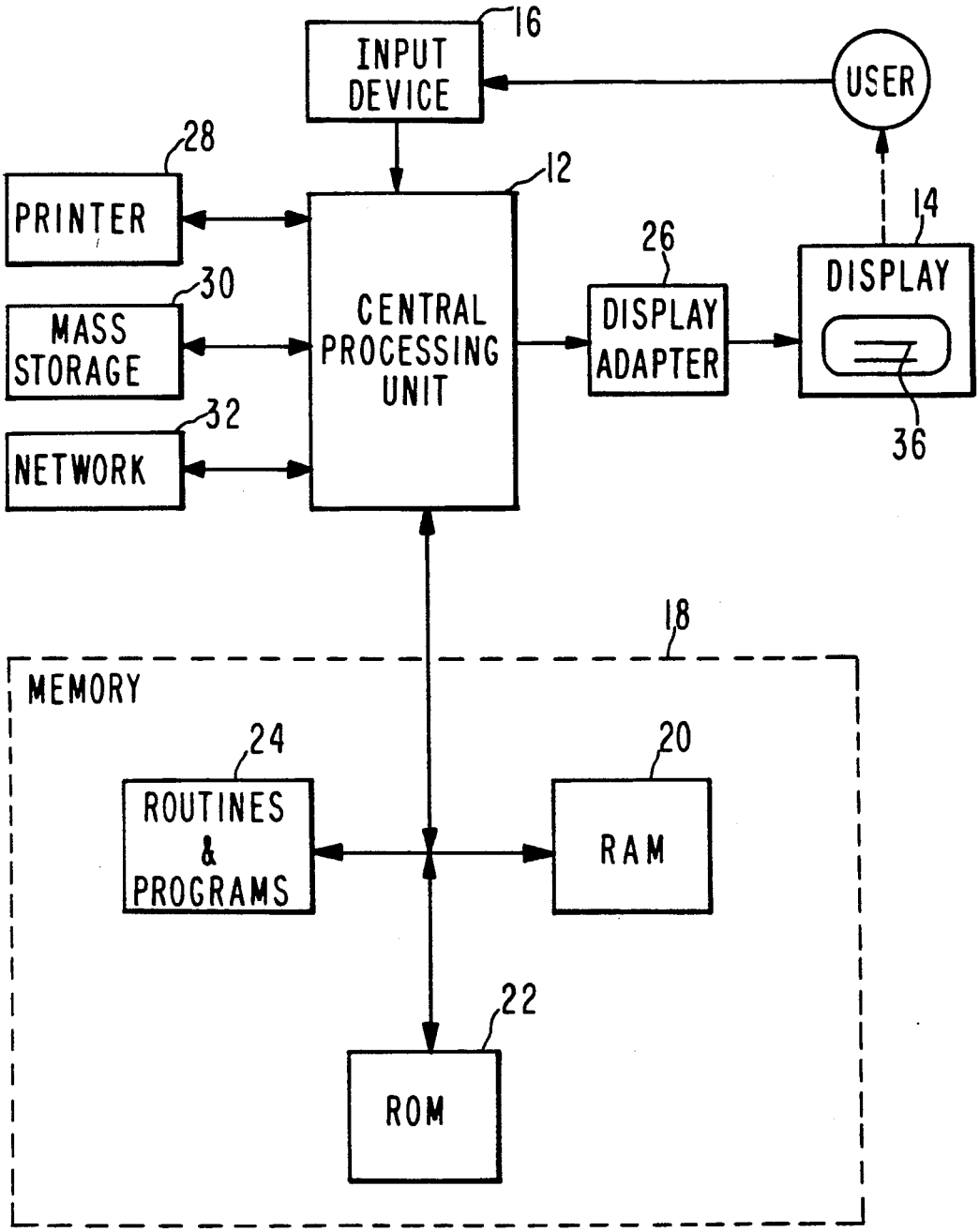
FIG. 1 illustrates a block diagram of a preferred embodiment of the system of the present invention for producing a graphical cursor.

Referring now to FIG. 1, a block diagram of a preferred embodiment for the system of the present invention is shown. The computer system preferably comprises a central processing unit 12, a display device 14, an input device 16, addressable memory 18 and a display adapter 26. The central processing unit 12 is coupled to and controls the display adapter 26 and the display device 14 in response to inputs supplied to the processing unit 12 by user manipulation of the input device 16. The processing unit 12 is also coupled to other sources of information including the addressable memory 18, mass storage 30 and a network 32 in a conventional architecture. A printer 28 is preferably coupled to the processing unit 12 to provide an output for information and a source for hard copies of the data.

The addressable memory 18 is a conventional type and preferably includes Random Access Memory 20 and Read Only Memory 22. The addressable memory 18 further comprises processing routines, programs and data 24 for interactive display control. For example, the memory 18 includes a mouse driver and mouse interrupt routines. The mouse driver routine translates information from the input device 16 into a format useable by the processing unit 12. The mouse interrupt routine is informed by the mouse driver if the input device 16 is used (e.g., if the mouse is moved and its new position). The memory 18 also includes routines for transferring data from the processing unit 12 to display adapter 26 and for the presentation of the data on the display device 14. The memory may further include other routines as conventional in the art.

The input device 16 is a conventional type as known in the art. The input device 16 is preferably a keyboard with a "mouse" type controller. For example, the input device may include a mouse or a track ball. A mouse is a small device with one or more buttons that can be rolled on a flat surface. A pointer or "mouse cursor" is produced on the display device 16 to represent the position of the mouse. Moving the mouse on the flat surface causes corresponding movement of the mouse cursor 34. By moving the mouse, the computer user can point at different objects shown on the display device 14. Once pointed to, an object can be manipulated by pressing the button on the mouse or entering a command via the keyboard.

The display device 14 is also a conventional type known in the art. The display device 14 is preferably a raster-type display used with the processing unit 12 in a conventional manner to produce images of characters generated from codes such as ASCII. The display device 14 also operates in a conventional manner with the input device 16 and the processing unit 12 to produce the cursor 34 on the display device 14 that reflects the location where data will be input or the object on the display device 14 that will be manipulated.

Figure 4:
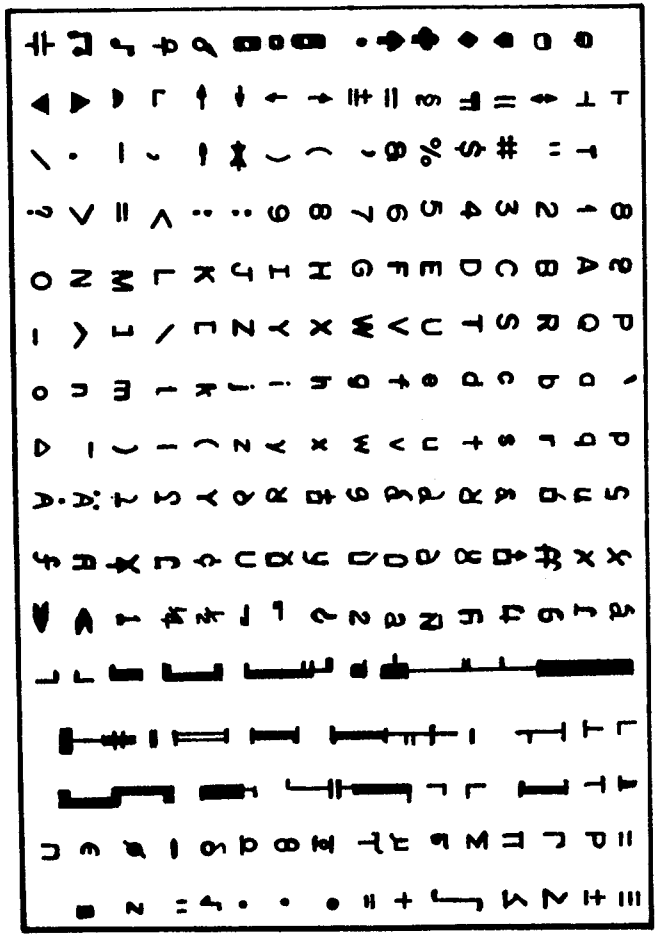
FIG. 4 (PRIOR ART)
FIG. 4 is a graphical representation of the character set of the prior art.

The display device 14 is coupled to the processing unit 12 by a display adapter 26. The display adapter 26 is a conventional type that allows font redefinition, and in an exemplary embodiment may be an EGA, VGA or XGA video adapter. As briefly discussed above, the display adapter 26 is coupled to the processing unit 12 to receive ASCII signals for producing an image on the display device in text mode or a signal for producing an image from a group of dots or pixels in graphics mode. In the present invention, the display adapter 26 operates in text mode and receives ASCII signals from the processing unit 12. The display adapter 26 preferably includes a display memory (not shown) and a font memory (not shown) for converting the ASCII signals into an image of a character or symbol. The display memory is used to store the 2000 ($80\times25$) characters that compose the image to be shown on a single screen 36 of the display device 14. The font memory preferably contains a dot pattern for each character in the character set. As shown in FIG. 4, the character set typically includes 256 different characters. The display adapter 26 refreshes the video screen 36 by reading the ASCII code for the characters from the display memory, indexing the font memory for the pattern of dots corresponding to the ASCII code in display memory and the outputting the appropriate pattern of dots to the display device 14 to produce the desired image.

Figure 5:
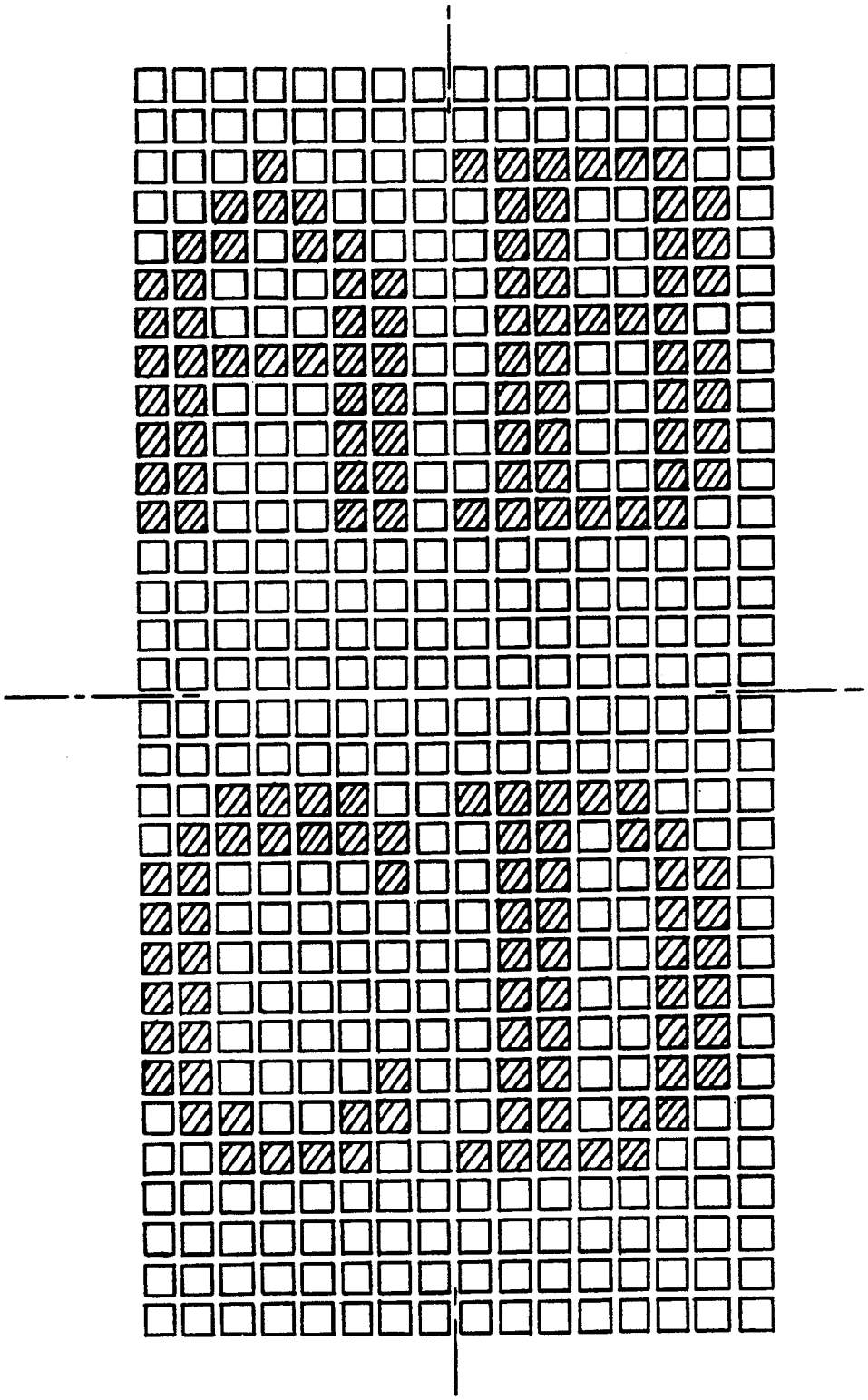
FIG. 5 (PRIOR ART)
FIG. 5 is a graphical representation of a portion of the display device displaying four adjacent characters.

The present invention uses the font redefinition capabilities of the display adapter 26 to produce the graphical cursor 34. The present invention can best be understood with reference to FIGS. 5 and 6. As briefly noted above, the screen 36 is typically divided into a grid of 2000 blocks with 80 columns and 25 lines in text mode operation. FIG. 5 illustrates four adjacent blocks on the screen 36 displaying the characters "A", "B", "C" and "D." In the exemplary embodiment, each block comprises a grid of $8\times16$ dots or pixels (e.g. for a VGA adapter). The block may have varying numbers of dots or pixels such as $8\times14$ dots for an EGA display adapter. The characters in the character set are generated by lighting the appropriate pattern of dots corresponding to each character.

Figure 6:
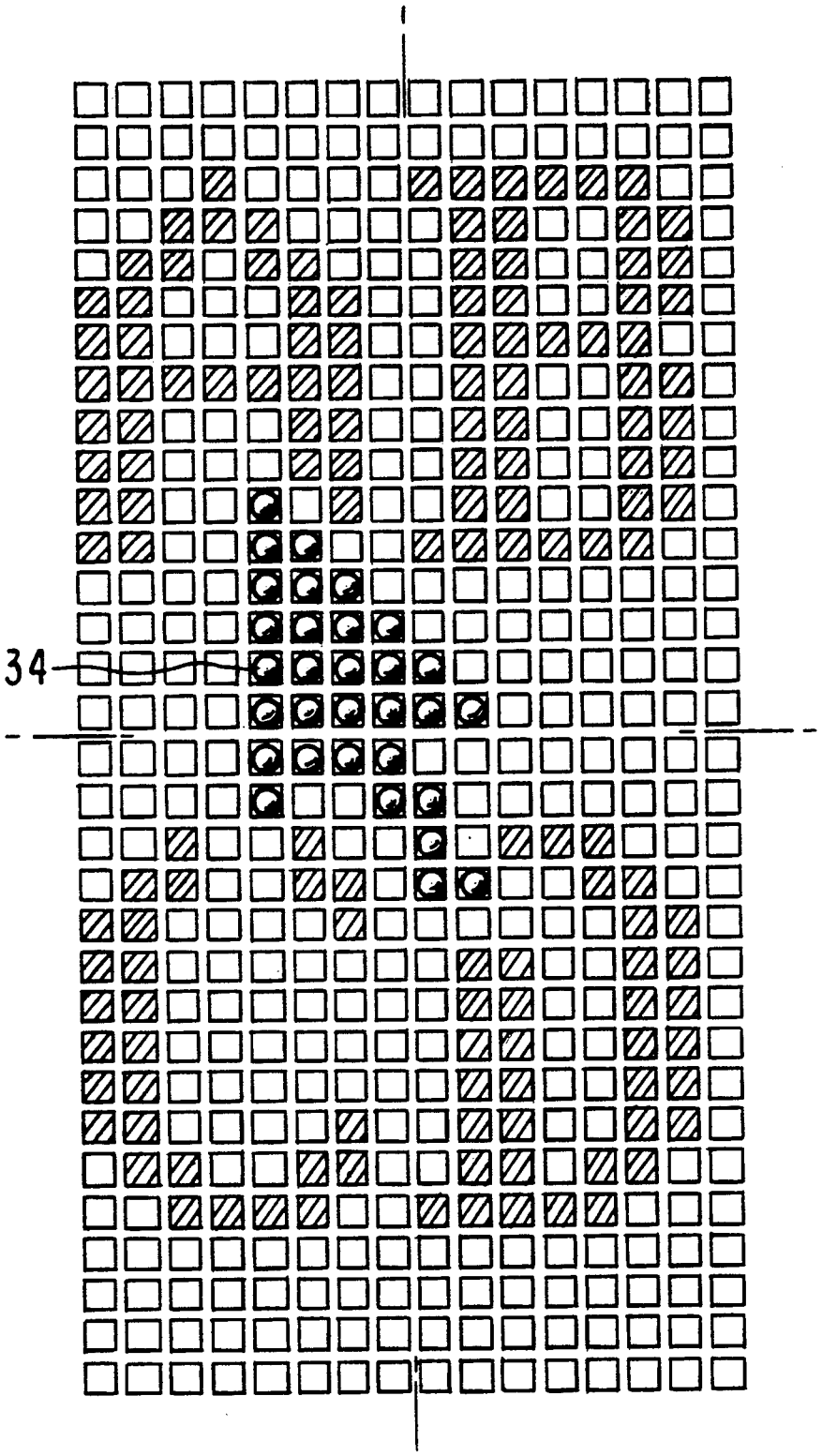
FIG. 6 is a graphical representation of a portion of the display device displaying four adjacent characters modified according to the preferred method of the present invention.

The present invention produces a GUI style cursor 34 in a text user interface by redefining the fonts for the blocks with the same position as the cursor 34. The present invention first determines the position of the cursor 34 and then stores the characters at the blocks with the same position in the grid as the cursor 34. The input device 16 sends signals indicating its new position to the processing unit 12 as the input device 16 is moved. As the input device 16 is moved, the dot patterns of the characters in the four blocks with the same position as the cursor 34 are read, and the symbol of the cursor 34 is overlaid on top of characters being displayed in the blocks to create four new fonts as illustrated in FIG. 6. When the cursor 34 is moved again, the new fonts at the block for the old cursor 34 position are replaced by the original four characters.

Figure 7:
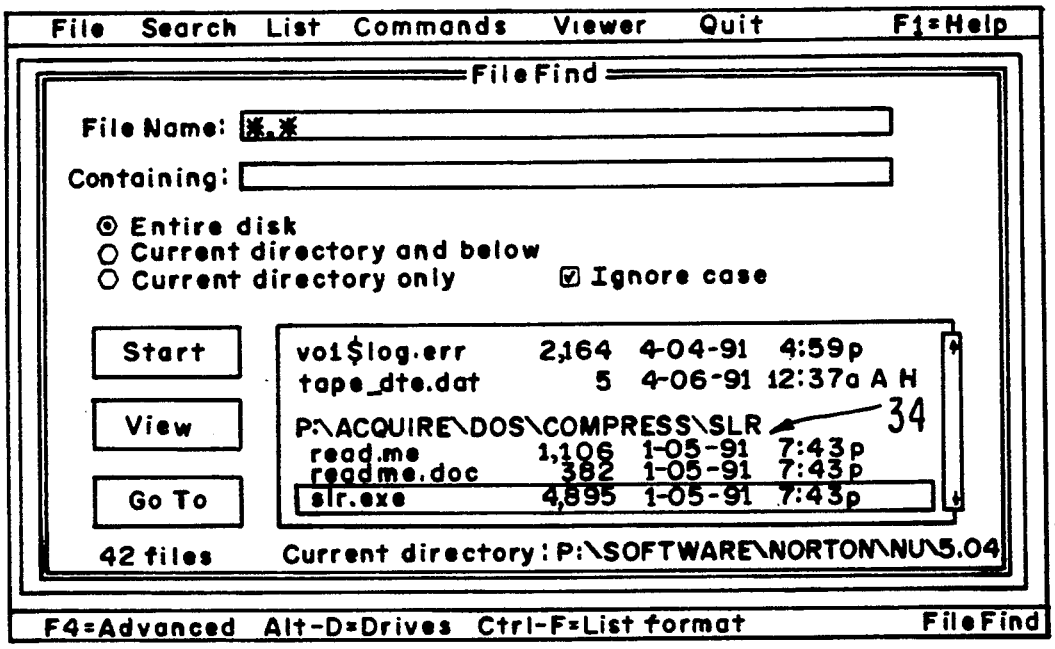
FIG. 7 is a graphical representation of a display device showing a cursor and data in text mode produced by the system and method of the present invention.

The graphic cursor 34 is preferably the same size as a single character or block. As shown in FIG. 6, the cursor 34 is preferably an arrow or a pointer. However, it should be understood by those skilled in the art that the cursor 34 may be a variety of other symbols by revising the bit map and bit mask used to generate the cursor 34. The present invention advantageously allows the cursor 34 to be positioned between blocks. Thus, it is possible for the cursor 34 to overlay as many as four blocks on the screen 36 at any instant. The cursor 34 is superimposed over the characters in the four blocks by creating new fonts for all four of the blocks. The creation of new fonts advantageously increases the accuracy provided by the cursor 34 and improves the smoothness of cursor movement because the present invention can position the cursor 34 between blocks and is limited only the number of dots in each block. For example, if the block is a group of dots 8 wide and 16 tall, the present invention adds the latitude to position the cursor 34 in 8 different positions in the horizontal direction and 16 different positions in the vertical direction for each block. The screen 36 of the display device 14 operating in text mode and displaying the graphical cursor 34 is illustrated in FIG. 7.

Figure 8:
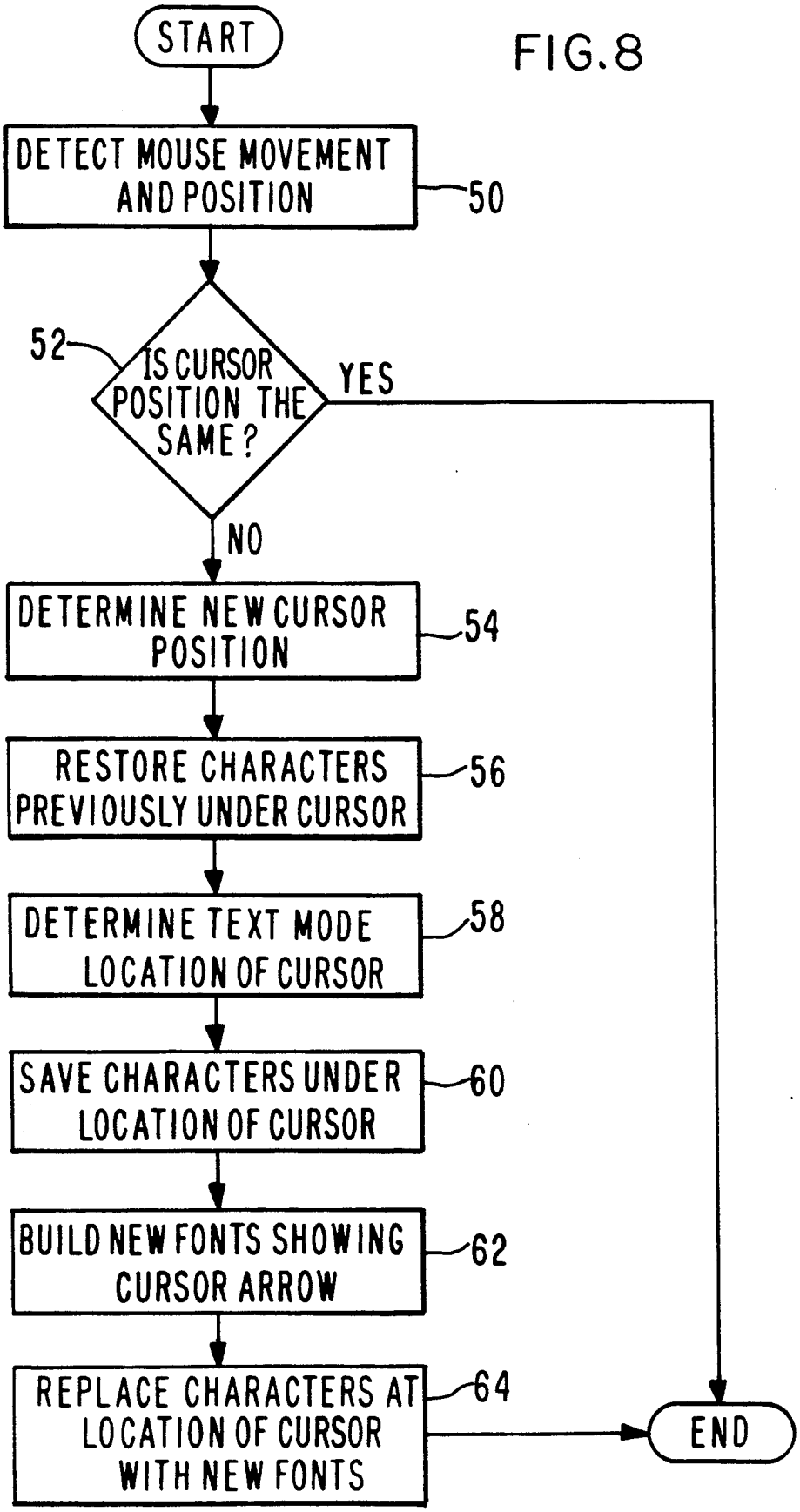
FIG. 8 is flowchart of the preferred method of the present invention for producing the graphical mouse cursor of the present invention.

The preferred method for generating and displaying the graphical cursor 34 in text mode begins by initializing variables for tracking the position of the cursor 34 and the position of the input device 16. The cursor 34 is then generated and displayed according to the method illustrated in FIG. 8. As shown in FIG. 8, the process for producing a graphical cursor 34 detects movement and the position of the input device or mouse 16 in step 50. For example, step 50 occurs when a mouse 16 interrupt occurs. The mouse interrupt indicates that the mouse 16 has been moved. The mouse driver reports where the mouse 16 is located by providing a set of coordinates for the horizontal and vertical position of the mouse 16. The present invention preferably sets the variables HDESKPOSN and VDESKPOSN to the horizontal and vertical positions, respectively, reported by the mouse driver.

In step 52, the method of the present invention compares the new position of the mouse 16 to the old position of the mouse 16. For example, the comparison may be performed by comparing the current values of HDESKPOSN and VDESKPOSN to values of HDESKPOSN and VDESKPOSN for the last mouse interrupt. If the values are the same then the position of the mouse 16 is the same and the cursor 34 is not moved. Thus, the method is complete and ends. However, if the position is not the same, then the display memory of the display adapter 26 must be updated to replace the characters with the same position as the cursor 34 with new fonts for producing an image of the cursor arrow superimposed on the existing characters.

In the preferred embodiment, the distance the mouse 16 is moved is reported in units call mickeys. A standard mickey represents moving the mouse 1/200th of an inch. However, it should be understood to those skilled in the art that the distance of a mickey may be redefined by user to be greater or smaller distances to reduce and increase, respectively, the speed at which the cursor 34 moves. The present invention establishes a one to one relationship between a mickey (movement of the mouse a 1/200th of an inch) and a dot on the screen 36 of the display. Thus, the screen 36 is 640 mickeys (80 columns × 8 dots wide) in the horizontal direction and 400 (25 lines × 16 dots tall) mickeys in the vertical direction, and mickeys can be used to measure movement of both the mouse 16 and the cursor 34. The screen 36 is also defined to have an origin at the upper left corner. The left edge and top edge of the screen 36 are minimums for the horizontal and vertical directions, respectively. The right edge and bottom edge of the screen 36 are maximums for the horizontal and vertical directions, respectively.

The process continues in step 54 where the new cursor position is determined. The graphical cursor 34 only tracks the movement of the mouse 16 to a limited degree. The cursor 34 does not move or disappear beyond the edges of the screen 36 despite continued movement of the mouse 16 in a particular direction. The additional movement of the mouse 16 in a direction that would move the cursor 34 off the screen 36 is ignored, and the cursor 34 remains displayed at the edge of the screen 36. The present invention uses the variables HSCREENPOSN and VSCREENPOSN to track the position of the cursor 34. The present invention determines the new cursor position with the HDESKPOSN and VDESKPOSN variables. The HSCREENPOSN is set to equal HDESKPOSN plus a horizontal adjustment factor. Similarly, the VSCREENPOSN is set to equal VDESKPOSN plus a vertical adjustment factor. The horizontal and vertical adjustment factors are variables for adjusting the position reported by the driver so that it remains with in the 640 by 400 mickey screen 36 grid. Essentially, the cursor position is set to be the mouse position unless the mouse position is beyond the edge of the screen 36. If the mouse position is below the vertical and horizontal minimums, then the cursor position is set to be the respective minimum. Similarly, if the mouse position exceeds the vertical and horizontal maximums, then the cursor position is set to be the respective maximum.

Next, in step 56, the characters previously under the cursor 34 are restored. As noted above, the characters or data with the same position as the cursor 34 are replaced by new fonts containing the cursor symbol superimposed over the characters. Thus, since the cursor 34 is now being moved to a new position, the blocks at the current position must be restored to the display the characters without the cursor symbol superimposed. The characters are preferably restored by retrieving the ASCII codes for the blocks at the old cursor position from a buffer, and writing the ASCII codes to the appropriate locations representing the current cursor position in display memory. The old cursor position is indicated by the text mode location or the variables TEXTROW and TEXTCOL that were used during the previously mouse interrupt to save the ASCII codes in the buffer and have not been updated yet.

In step 58, the text mode location for the cursor 34 is calculated. The text mode location is preferably calculated by using the new cursor position determined in step 56. The new text mode location is stored in the variables TEXTROW and TEXTCOL. Since the new cursor position is provided in mickeys, the text mode location is equal to the values for the new cursor position divided by the number of mickeys or dots per text mode block. For example, TEXTROW is preferably calculated by setting TEXTROW equal to the VSCREENPOSN divided by 16 since there are 16 dots per block in the vertical direction. Similarly, TEXTCOL is preferably calculated by setting TEXTCOL equal to the HSCREENPOSN divided by 8 since there are only 8 dots per block in the horizontal direction.

Next, the characters at the current mouse position or the text mode location are saved into the buffer in step 60. The preferred embodiment of the present invention preferably stores four characters near the text mode location into the buffer. For example, the ASCII codes for the four characters or blocks stored in the display memory of the display adapter 26 at the locations with the coordinates (TEXTROW, TEXTCOL), (TEXTROW, TEXTCOL+1), (TEXTROW+1, TEXTCOL) and (TEXTROW+1, TEXTCOL+1) are stored in the buffer. However, if the TEXTCOL is equal to 79 (the maximum), then the two characters at TEXTCOL+1 are not saved. Similarly, if the vertical maximum is reached, TEXTROW is equal to 24, then the two characters at TEXTROW+1 are not saved. The ASCII codes for the characters saved in this step are later used to restore the display 14 when the cursor 34 is moved to another position as discussed above with reference to step 56.

Next, in step 60, the method of the present invention preferably constructs new fonts for the blocks on the screen 36 with the same location as the cursor 34. The cursor 34 can overlay up to four blocks. Thus, in an exemplary embodiment four new fonts for the blocks located at the coordinates (TEXTROW, TEXTCOL), (TEXTROW, TEXTCOL+1), (TEXTROW+1, TEXTCOL), (TEXTROW+1, TEXTCOL+1) are created. Each of the four blocks is processed in the same way to produce a new font. The present invention redefines the character dot patterns of four characters in the character set (e.g., See FIG. 4) to produce the new fonts because the display adapters 26 often do not permit modification of the dot pattern for a single character in a single location. Since most display adapters 26 only allow redefinition of all instances of the character on the screen 36, the present invention selects four characters from the character set that are rarely used if ever. These four characters are redefined to display the character for the location of the cursor 34 with all or a portion of the cursor 34 superimposed on the image of the character. For example, referring to FIG. 6, one of the new fonts created to display the cursor 34 in the position TEXTROW, TEXTCOL is the block in the upper left hand corner. The new font is the dot pattern for producing an "A" with a portion of the arrow of the cursor 34 superimposed thereon. The present invention preferably uses a bit map and mask to superimpose the cursor symbol over the portions of the dot patterns of the characters displayed in the cursor position. Finally, after the new fonts have been created, they are stored in the font memory of the display adapter 26 and used to produce the image of the graphical cursor 34 on the display device 14 in step 64. The display memory is also updated with by storing the ASCII codes for the new fonts in the memory locations of display memory corresponding to the coordinates (TEXTROW, TEXTCOL), (TEXTROW, TEXTCOL+1), (TEXTROW+1, TEXTCOL), (TEXTROW+1, TEXTCOL+1) on the display device 14.

Figure 9:
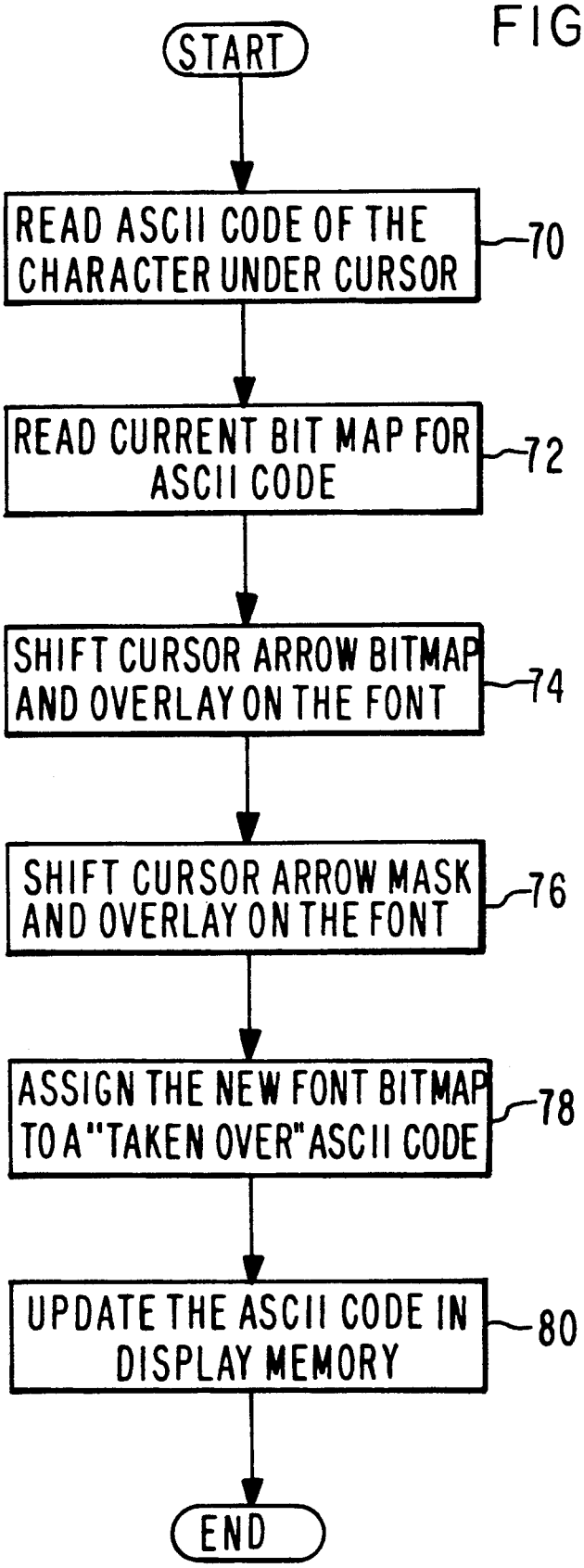
FIG. 9 is a flowchart of the preferred method for producing new fonts including the cursor arrow.

Referring now to FIG. 9, the preferred method for creating the new fonts with the cursor 34 superimposed over the characters at the font location is illustrated. As mentioned above, the process is preferably identical for generating new fonts for all four of the adjacent block locations. In step 70, the method of the present invention reads the ASCII code for the character under the cursor 34. This preferably performed by reading the ASCII code of the character at the coordinate (e.g., TEXTROW, TEXTCOL) for which the font is being generated. In step 72, the ASCII code retrieved in step 70 is used to read the corresponding dot pattern from the font memory of the display adapter 26. Then in step 74, the bit map for the cursor arrow is shifted and then overlaid on the font retrieved in step 72. Since the cursor arrow may be positioned between blocks, only a portion of the cursor arrow may be superimposed on the font from step 72. The cursor arrow may have 8 different locations horizontally and 16 different positions vertically. In step 76, a mask used to superimpose the arrow bit map is also shifted and overlaid on the font from step 72. Therefore, the bit map and mask for the cursor arrow are shifted the number of dots corresponding to the movement of the mouse 16 reported in mickeys. The vertical shift is preferably equal to VSCREENPOSN modulo 16 and the horizontal shift is equal to HSCREENPOSN modulo 8 for the upper left character.

Next in step 78, a new ASCII code is chosen for the new font redefined in steps 74 and 76. The ASCII code chosen is preferably a joining character that is seldom used. For example, the ASCII codes used are 210, 211, 215, 241, and 242, although other joining character codes may be used. The cursor 34 may be displayed over more than one block; therefore, joining characters must be used. Joining characters are a special group of 32 characters provided in text mode operation. The joining characters are distinct from normal characters because they will join with the character adjacently displayed. The display adapter actually presents each block as a group of dots 9 wide and 16 tall although the user can define only 8 dots in width. For the normal characters in the character set, there is no control over the ninth column of dots which will be forced to be unlit or off when displayed. This provides the space division needed between most characters. However, for joining characters, the ninth column of dots will be a duplicate of the eighth column of dots. Once the new code has been chosen, it is used to index the font memory of the display adapter 26. The dot pattern generated in step 76 is then stored in the font memory at the location of the new code just chosen. Finally, in step 80, the display memory in the display adapter 26 is updated by writing the ASCII code chosen in step 78 at the screen coordinates (TEXTROW, TEXTCOL) for the block being replaced.

As note above, the method of FIG. 9 is used to revise the display and font memory for the four blocks near the cursor position to produce the image of the cursor 34 superimposed on the characters at the cursor's position. However, for the lower left block, the coordinates used for constructing the new font is (TEXTROW+1, TEXTCOL), the horizontal shift is equal to modulo 8 of the HSCREENPOSN, and the vertical shift is equal to 16 minus the modulo 16 of the VSCREENPOSN. For the block in the upper right, the coordinates used for constructing the new font is (TEXTROW, TEXTCOL+1), the horizontal shift is equal to modulo 8 of the HSCREENPOSN, and the vertical shift is equal to 16 minus the modulo 16 of the VSCREENPOSN. Similarly, for the block at the lower right, the coordinates used for constructing the new font is (TEXTROW+1, TEXTCOL+1), the horizontal shift is equal to 8 minus the modulo 8 of the HSCREENPOSN and the vertical shift is equal to 16 minus the modulo 16 of the VSCREENPOSN. Additionally, it should be understood that if the cursor position is the either the vertical or horizontal maximum, then only the two top blocks or the two left blocks, respectively, are redefined using the process of FIG. 9.

What is claimed is:

1. A method for generating a graphical cursor in text mode operation of a computer system having a processing unit, an input device, a display device, a buffer, and a display adapter having a display memory and a font memory, wherein said display memory stores character codes for characters that are destined to be displayed on said display device on a multibit block by multibit block basis, and said font memory converts each character code to a corresponding plurality of bits, said method comprising the steps of:

determining a new cursor bit position;

converting the new cursor bit position into several adjoining new cursor text mode block locations:

restoring from said buffer a first set of character codes into the display memory at several adjoining old cursor text mode block locations;

saving into said buffer a second set of character codes corresponding to the characters being displayed at the new cursor text mode block locations;

building new fonts using fonts corresponding to the second set of character codes and a cursor bit map;

assigning, within the font memory, the new fonts to a set of seldom used characters;

replacing, at the new cursor text mode block locations within the display memory, the second set of character codes with character codes corresponding to the set of seldom used characters; and generating an image on the display device from the modified display memory using the display adapter.

2. The method of claim 1, further comprising the step of detecting the position and movement of the input device.

3. The method of claim 2, wherein the position and movement of the input device are detected using a mouse interrupt and a mouse driver.

4. The method of claim 3, wherein the step of determining the new cursor bit position includes converting data from the mouse driver to coordinates of a screen of the display device.

5. The method of claim 4, wherein the step of determining the new cursor bit position adjusts the new cursor bit position if it is beyond a horizontal maximum of the display device.

6. The method of claim 4, wherein the step of determining the new cursor bit position adjusts the new cursor bit position if it is beyond a vertical maximum of the display device.

7. The method of claim 1, wherein the restoring step comprises the substeps of:

retrieving character codes for the characters originally present at said old cursor text mode block locations from the buffer; and storing said character codes for the said originally present characters at said old cursor text mode block locations.

8. The method of claim 1, wherein the saving step comprises the substeps of:

retrieving the second set of character codes from the new cursor text mode block locations; and storing said second set of character codes in the buffer.

9. The method of claim 1, wherein the building step comprises, for each of the new fonts, the substeps of:

determining the font for the corresponding character code from the second set of character codes;

shifting a bit map of the cursor to correspond to the new cursor bit position; and overlaying the shifted bit map of the cursor onto the font for the corresponding character code from the second set of character codes to produce the new font.

* * * * *